US005903945A

United States Patent [19]

Lundie

[11] Patent Number: 5,903,945

[45] Date of Patent: May 18, 1999

[54] PIPELINE PIG

[76] Inventor: Kevin R.J. Lundie, RR #4, Site 3, Box 8, Lacombe, AB, Canada, TOC-1SO

[21] Appl. No.: 08/806,709

[22] Filed: Feb. 27, 1997

[51] Int. Cl.[6] ..... B08B 9/04

[52] U.S. Cl. ..... 15/104.061

[58] Field of Search ..... 15/3.5, 3.51, 3.52, 15/104.061, 104.062, 104.063

[56] References Cited

U.S. PATENT DOCUMENTS

| | | | |
|---|---|---|---|
| 2,188,959 | 2/1940 | Schaer | 15/104.061 |
| 3,605,159 | 9/1971 | Girard . | |
| 3,667,544 | 6/1972 | Allimon . | |
| 4,016,620 | 4/1977 | Powers . | |
| 4,720,884 | 1/1988 | Ralls . | |
| 4,825,498 | 5/1989 | Rankin . | |
| 5,384,929 | 1/1995 | Smith . | |
| 5,457,841 | 10/1995 | Minton . | |
| 5,533,224 | 7/1996 | Knapp . | |
| 5,555,585 | 9/1996 | Fowler . | |

FOREIGN PATENT DOCUMENTS

| | | | |
|---|---|---|---|
| 2632547 | 12/1989 | France | 15/104.061 |
| 3122643 | 1/1983 | Germany | 15/104.063 |
| 905007 | 9/1962 | United Kingdom | 15/104.061 |

*Primary Examiner*—Randall E. Chin

*Attorney, Agent, or Firm*—James E. Bradley; Andrew J. Dillon

[57] ABSTRACT

A pipeline pig has a body with two symmetrical, flexible end portions which give the pig a generally ovate appearance. The end portions are separated by and contain a flexible core. The end portions have a rounded exterior surface and an internal cylindrical cavity. Each cavity has a beveled entry portion for receiving the core. Each end portion also has an outer cleaning area for an abrasive band with teeth for scrubbing a pipeline. Polishing teeth are on an upper portion of the band while coarse teeth are on a lower portion of the band. The core allows the pig to flex as it passes through nonlinear pipeline. The core has a flexible linkage which gives the pig the ability to undergo extensive flexing while maintaining the integrity and strength of the pig. Each end of the linkage receives a bolt which extends through an axial hole in each end portion for fastening the end portions to the core. As the pig moves through pipeline with light build-up, the polishing teeth gently remove it. As the pig moves through pipeline with heavy build-up, the pig is compressed so that the coarse teeth cut and fracture the heavy build-up. When the pig moves back into cleaner pipeline, the pig expands to its original size, thereby allowing the polishing teeth to clean once again. In nonlinear pipeline sections, the pig flexes so that the abrasive bands stay in uniform contact with the inner pipeline wall.

17 Claims, 1 Drawing Sheet

PIPELINE PIG

TECHNICAL FIELD

This invention relates in general to cleaning pipelines, and in particular to a pipeline pig for use in cleaning the interior wall of a pipeline.

BACKGROUND ART

The interior surfaces of pipelines employed for moving fluids tend to become encrusted through chemical reaction or deposits of solids from the fluids. As encrustation builds up, the maximum fluid carrying potential of the pipeline is decreased. It has long been a practice of pipeline operators to periodically clean the interior of pipelines by passing pipeline or cleaning pigs through them.

A cleaning pig is a device that fits in the interior of a pipeline and is moved by fluid flow through the pipeline. Some means is provided on the pig to engage the interior wall of the pipeline to scrape or brush the interior to dislodge solid materials. Pigs may be propelled with water, petroleum based fluids or gases such as compressed air or nitrogen. Some pigs are required to clean both linear pipelines and nonlinear piping connections such as elbows, 180 degree return bends and plug type headers.

One type of pig utilizes a cylindrical body and has helical or flange-like abrasive elements for scrubbing. When the pig travels around bends, the pig body gathers on its inner radius and stretches on its outer radius. This gathering effect causes the pig to clean the portion of pipeline near its inner radius more aggressively than the portion of the pipeline near its outer radius. Over time, use of this pig may cause premature pipe wear or failure.

DISCLOSURE OF INVENTION

A pipeline pig has a longitudinal axis and a body with two symmetrical, flexible end portions which give the pig a generally ovate appearance. The end portions very nearly abut one another along their edges, but are separated by and contain a flexible core. The end portions have a rounded exterior surface and an internal cylindrical cavity. Each cavity has a beveled entry portion for receiving the core.

Each end portion also has a beveled cleaning area for an abrasive band with cleaning teeth for scrubbing the interior of a pipeline. Polishing teeth are located on an upper portion of the band while coarse teeth are located on a lower portion of the band.

The core allows the pig to flex about its midpoint when the pig passes through nonlinear pipeline. The core has a flexible linkage or knuckle joint which gives the pig the ability to undergo extensive flexing while maintaining the integrity and strength of the pig. Each end of the knuckle joint receives a bolt which extends through an axial hole in each end portion for fastening the end portions to the core.

As the pig moves through pipeline with light build-up, the polishing teeth contact the build-up and gently remove it. As the pig moves through pipeline with heavy build-up, the pig is compressed so that the coarse teeth cut and fracture the heavy build-up. When the pig moves out of pipeline with heavy build-up and into cleaner pipeline, the pig expands to its original size, thereby allowing the polishing teeth to clean once again. When the pig encounters various nonlinear pipeline sections, the pig flexes about its midpoint so that the abrasive bands stay in uniform contact with the inner pipeline wall.

BEST MODE FOR CARRYING OUT THE INVENTION

Figure 1:
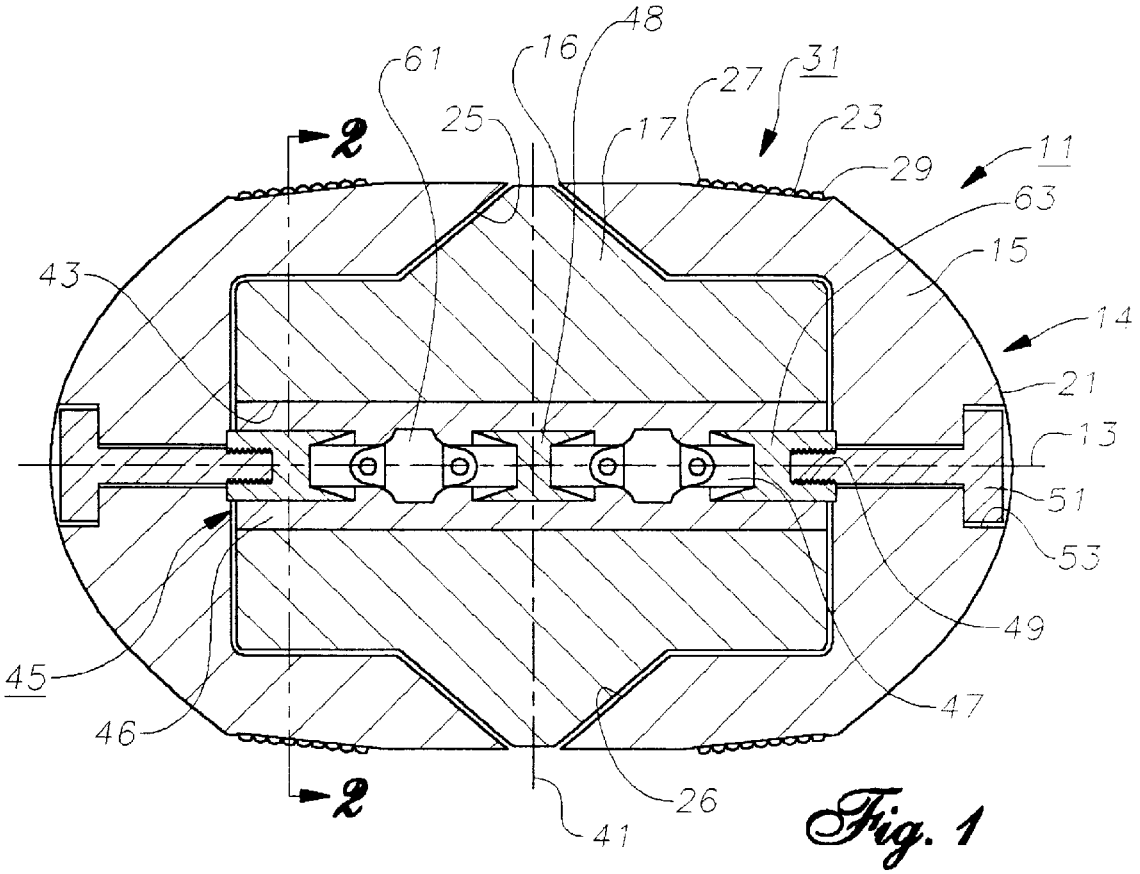
FIG. 1 is a sectional side view of a pipeline pig constructed in accordance with the invention.
Figure 2:
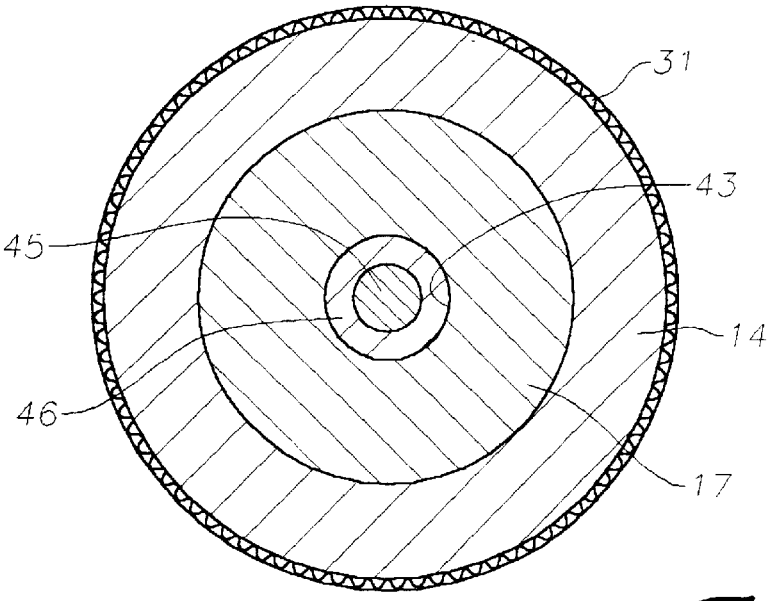
FIG. 2 is a sectional front view of the pig of FIG. 1 taken along the line 2—2.

Referring to FIGS. 1 and 2, a pipeline pig 11 with a longitudinal axis 13 is shown. Pig 11 has a body 14 with two symmetrical, flexible end portions 15 which give pig 11 a generally ovate appearance. Portions 15 very nearly abut one another at edges 16, but are separated by and contain a core 17. Portions 15 are made of tough plastic and have a rounded exterior surface 21 and an internal cylindrical cavity 25. Each cavity 25 has a beveled entry portion 26 for receiving core 17.

Each portion 15 also has an outer annular recess 23 on its exterior. Recess 23 is a beveled cleaning area and is provided for locating an abrasive band 31. Band 31 has cleaning teeth for scrubbing the interior of a pipeline (not shown). Band 31 extends around and is rigidly secured to recess 23 with a high strength adhesive. Polishing teeth 27 are located on an upper portion of band 31. Coarse teeth 29 are located on a lower portion of band 31.

Core 17 is comprised of a more flexible and softer material than portions 15, which allows pig 11 to flex about a midpoint 41 when pig 11 passes through nonlinear pipeline configurations. The central portion of core 17 has the same outer diameter as the maximum outer diameter of portions 15. Core 17 has an axial bore 43 for closely receiving a flexible linkage or knuckle joint 45. Knuckle joint 45 comprises two universal joints 61 joined by a nipple 48.

Knuckle joint 45 gives pig 11 the ability to undergo extensive flexing while maintaining the integrity and strength of pig 11. In the preferred embodiment, knuckle joint 45 is encased or embedded in a cylinder of urethane 46. Each end 47 of knuckle joint 45 is secured to a nipple 63 which receives a bolt 51. Bolts 51 extend through axial, countersunk holes 53 in body 14 and securely fasten portions 15 to core 17.

Body 14, core 17 and knuckle joint 45 may be comprised of a variety of materials having different densities and flexibility properties. These materials give the users of pig 11 the ability to change its characteristics to suit various conditions.

In operation, pig 11 is assembled by first inserting knuckle joint 45 into core 17 so that ends 47 are flush with each end of core 17. A portion 15 is then placed over one end of core 17 so that core 17 seats in cavity 25. Bolt 51 is inserted through hole 53 and threaded into hole 49. These steps are then repeated for the remaining portion 15 and bolt 51. Pig 11 is capable of carrying electronic equipment (not shown) within core 17 for tracking purposes.

Pig 11 is placed in a pipeline (not shown) having an inner diameter that is approximately equal to the outer diameter of pig 11. Pig 11 is forced through the pipeline with pressurized fluid. As pig 11 moves through pipeline with light build-up, polishing teeth 27 contact the build-up and gently remove it. As pig 11 moves through pipeline with heavy build-up, pig 11 is compressed and bands 31 contract so that coarse teeth 29 cut and fracture the heavy build-up. When pig 11 moves out of pipeline with heavy build-up and into cleaner pipeline, pig 11 and bands 31 expand to their original size, thereby allowing polishing teeth 27 to clean once again. When pig 11 encounters various nonlinear pipeline sections (not shown), pig 11 flexes about midpoint 41 so that abrasive bands 31 stay in uniform contact with the inner pipeline wall.

The invention has several advantages. The pig's two-piece body and core design gives the pig flexibility to navigate nonlinear pipeline sections. This flexibility allows the pig to keep its abrasive elements in uniform contact with the pipeline wall, thereby reducing the possibility of premature pipeline wear or failure. The use of flexible materials in both the body and the core allows the abrasive elements to selectively scrub both light and heavy build-up pipeline sections. The backbone keeps the pieces of the pig together while maintaining strength and flexibility to resist tearing and breaking.

While the invention has been shown in only one of its forms, it should be apparent to those skilled in the art that it is not so limited, but is susceptible to various changes without departing from the scope of the invention.

I claim:

1. A pipeline pig having a longitudinal axis for cleaning pipe, comprising:

a pig body having two axially spaced-apart end portions, each with an outer surface, the pig body being dimensioned to be slidably moved through a pipeline;

an abrasive element rigidly secured to each of the outer surfaces for contacting an interior surface of the pipeline; and a flexible core sandwiched between and connecting the end portions together, the core enabling the pig to flex at a midpoint when the pig moves through nonlinear pipe; and wherein the end portions have greater hardness than the core.

2. The pipeline pig of claim 1 wherein the end portions have a concave inner portion.

3. The pipeline pig of claim 1 wherein the end portions have rearward edges which are spaced apart; and wherein a maximum diameter of the core is approximately equal to an outer diameter of the end portions at the rearward edges.

4. A pipeline pig having a longitudinal axis for cleaning pipe, comprising:

a pig body having two axially spaced-apart end portions, each with an outer surface, the pig body being dimensioned to be slidably moved through a pipeline;

an abrasive element rigidly secured to each of the outer surfaces for contacting an interior surface of the pipeline; and a flexible core sandwiched between and connecting the end portions together, the core enabling the pig to flex at a midpoint when the pig moves through nonlinear pipe;

an axial bore in the core;

a flexible linkage located in the core; and a releasable fastener connecting each of the end portions to one end of the linkage to join the core and end portions together.

5. A pipeline pig having a longitudinal axis for cleaning pipe, comprising:

a pig body having two axially spaced-apart end portions, each with an outer surface, the Pig body being dimensioned to be slidably moved through a pipeline;

an abrasive element rigidly secured to each of the outer surfaces for contacting an interior surface of the pipeline; and a flexible core sandwiched between and connecting the end portions together, the core enabling the pig to flex at a midpoint when the pig moves through nonlinear pipe; and wherein the abrasive element comprises an abrasive band with cleaning teeth that is transverse to the axis.

6. A pipeline pig having a longitudinal axis for cleaning pipe, comprising:

a pig body having two axially spaced-apart end portions, each with an outer surface, the pig body being dimensioned to be slidably moved through a pipeline;

an abrasive element rigidly secured to each of the outer surfaces for contacting an interior surface of the pipeline; and a flexible core sandwiched between and connecting the end portions together, the core enabling the pig to flex at a midpoint when the pig moves through nonlinear pipe; and wherein the pig is ovate in shape.

7. A pipeline pig having a longitudinal axis for cleaning pipe, comprising:

a pig body having two axially spaced-apart end portions, each with an outer surface and a rearward edge, the pig body being dimensioned to be slidably moved through a pipeline;

an abrasive element rigidly secured to each of the outer surfaces for contacting an interior surface of the pipeline; and a flexible core sandwiched between and connecting the end portions together, the core enabling the pig to flex at a midpoint when the pig moves through nonlinear pipe;

a releasable fastener for connecting each of the end portions to the core; and wherein the rearward edges of the end portions are axially spaced apart from each other.

8. The pipeline pig of claim 7, further comprising:

an axial bore in the core; and a flexible linkage located in the bore of the core, the fastener connecting each of the end portions to one end of the linkage to join the core and end portions together.

9. The pipeline pig of claim 7 wherein the abrasive element comprises an abrasive band with cleaning teeth that is transverse to the axis.

10. The pipeline pig of claim 7 wherein the pig is ovate in shape.

11. The pipeline pig of claim 7 wherein the end portions have a concave inner portion and the core has mating convex portions.

12. The pipeline pig of claim 7 wherein a maximum diameter of the core is approximately equal to an outer diameter of the end portions at the rearward edges.

13. The pipeline pig of claim 7 wherein the end portions have less flexibility than the core.

14. A pipeline pig having a longitudinal axis for cleaning pipe, comprising:

a pig body having two axially spaced-apart end portions, each with an outer surface, a rearward edge and a concave inner portion, the pig body being dimensioned to be slidably moved through a pipeline;

an abrasive element rigidly secured to each of the outer surfaces for contacting an interior surface of the pipeline; and a flexible core sandwiched between and connecting the end portions together, the core having convex portions that mate with the concave inner portions of the end portions, the core enabling the pig to flex at a midpoint when the pig moves through nonlinear pipe;

the core having an axial bore and an outer diameter substantially equal to a maximum outer diameter of the end portions;

a flexible linkage located in the bore of the core for connecting each of the end portions to the core;

a releasable fastener for connecting each of the end portions to one end of the linkage to join the core and end portions together; and wherein the rearward edges of the end portions are axially spaced apart from each other.

15. The pipeline pig of claim 14 wherein the abrasive element comprises an abrasive band with cleaning teeth that is transverse to the axis.

16. The pipeline pig of claim 14 wherein the pig is ovate in shape.

17. The pipeline pig of claim 14 wherein the end portions have greater hardness than the core.

* * * * *